US005841331A

United States Patent [19]

Tsujiguchi

[11] Patent Number: 5,841,331

[45] Date of Patent: Nov. 24, 1998

[54] DIELECTRIC FILTER

[75] Inventor: Tatsuya Tsujiguchi, Kanazawa, Japan

[73] Assignee: Murata Manufacturing Co., Ltd., Japan

[21] Appl. No.: 799,276

[22] Filed: Feb. 13, 1997

[30] Foreign Application Priority Data

Feb. 16, 1996 [JP] Japan ..... 8-029364

[51] Int. Cl.[6] ..... H01P 1/202; H01P 1/205

[52] U.S. Cl. ..... 333/202; 333/206

[58] Field of Search ..... 333/202, 206, 333/207, 222, 223

[56] References Cited

U.S. PATENT DOCUMENTS

| | | | |
|---|---|---|---|
| 4,668,925 | 5/1987 | Towatari et al. | 333/219.1 |
| 4,757,284 | 7/1988 | Ueno | 333/203 |
| 4,890,079 | 12/1989 | Sasaki | 333/206 |
| 5,329,687 | 7/1994 | Scott et al. | 29/527.2 |
| 5,572,174 | 11/1996 | Kitaichi et al. | 333/206 |
| 5,642,084 | 6/1997 | Matsumoto et al. | 333/206 X |

FOREIGN PATENT DOCUMENTS

| | | | |
|---|---|---|---|
| 470730 | 2/1992 | European Pat. Off. . | |
| 483820 | 5/1992 | European Pat. Off. . | |
| 556573 | 8/1993 | European Pat. Off. . | |
| 629992 | 12/1994 | European Pat. Off. . | |
| 0040802 | 2/1987 | Japan | 333/202 |
| 0026105 | 1/1990 | Japan | 333/222 |
| 4-103201 | 4/1992 | Japan | 333/202 |
| 6-85503 | 3/1994 | Japan | 333/222 |
| 6-140805 | 5/1994 | Japan | 333/202 |
| 7-288404 | 10/1995 | Japan | 333/206 |

*Primary Examiner*—Seungsook Ham

*Attorney, Agent, or Firm*—Ostrolenk, Faber, Gerb & Soffen, LLP

[57] ABSTRACT

Resonance holes whose inner surfaces are covered with an inner conductor (or other inner conductor structures) are formed in a dielectric block such that the resonance holes extend between two opposing end faces. The outer surface of the dielectric block is covered with an outer conductor. Input/output electrodes are formed out of part of the outer conductor at predetermined locations on the surface of the dielectric block. A slot is formed near one end face of the dielectric block so that the inner conductors are separated by the slot into isolated parts. By means of the slot, an electrically open end of each resonator is formed at a location spaced inward from the physical end face. Thus it is possible to produce a low-cost high-performance dielectric filter in which an electrically open end is formed with high accuracy at a location spaced inward from the physical end face of a dielectric block.

56 Claims, 5 Drawing Sheets

DIELECTRIC FILTER

BACKGROUND OF THE INVENTION

1. Field of the Invention

The present invention relates to a dielectric filter, and more particularly to a dielectric filter for use as an RF filter in a mobile telephone or other radio communication device or for use as an antenna duplexer.

2. Description of the Related Art

FIG. 6 illustrates the structure of a conventional dielectric filter using a dielectric block. In this and other figures, areas filled with dots represent such areas where the bare surface of the dielectric block is exposed to the outside (without having a conductor coated thereon).

In this dielectric filter, as shown in FIG. 6, there are provided resonance holes 2, 2 extending through a rectangular dielectric block 1 from its one end face to the opposite end face wherein the inner surface of each resonance hole is covered with an inner conductor 3 serving as a resonance conductor. The outer surface of the dielectric block 1 is almost entirely covered with an outer conductor 4 serving as a ground conductor. Input/output electrodes 5, 5 are disposed at predetermined locations on the outer conductor 4. The input/output electrodes 5, 5 extend to side faces from those areas formed on the bottom surface serving as an attachment surface for mounting. (The dielectric block 1 is placed such that the bottom surface is up in FIG. 6.) These input/output electrodes 5, 5 are electrically isolated from the output conductor 4 by outer-conductor-free areas 5*a*.

An inner-conductor-free area 3*a* is formed near one opening end of each resonance hole 2 so that each inner conductor 3 is isolated from the outer conductor 4 by the inner-conductor-free area 3*a*. At the opposite opening end of each resonance hole 2, the inner conductor 3 is electrically connected to the outer conductor 4. The inner-conductor-free area 3*a* causes the corresponding end of each resonance hole 2 to act as an electrically open end. The inner-conductor-free area 3*a* may be formed by removing the inner conductors 3 formed on the inner surfaces of the resonance holes 2 along the entire circumference with a desired width using a router or the like.

Each resonance hole 2, 2 forms one resonator stage and thus the dielectric filter includes two resonator stages. External coupling capacitance is formed between each input/output electrode 5 and the corresponding inner conductor 3, and each resonator stage is coupled with the corresponding input/output electrode 5 via the external coupling capacitance. The external coupling also depends on capacitance which occurs between the outer conductor 4 and the input/output electrodes 5 (hereafter such capacitance will be referred to as input/output electrode-to-outer conductor capacitance).

In this dielectric filter, as can be seen from the above description, the electrically open end of each resonator is formed at a location spaced inward from the geometrical end so that leakage of electromagnetic field (magnetic field) from the opening end of the resonance hole is suppressed by the shielding effect provided by the outer conductor 4 present near the opening end.

In the conventional dielectric filter, however, it is required to form the inner-conductor-free areas or the electrically open ends of resonators by removing a part of the inner conductor along its entire circumference using a router inserted into each resonance hole. This process for forming the inner-conductor-free areas requires a long time and it is difficult to achieve high accuracy in width of the inner-conductor-free areas.

This problem becomes serious in particular when it is required to form resonance holes with a small diameter. To obtain stronger external coupling so as to realize a wide-band filter, it is required to increase the external coupling capacitance by increasing the size of the input/output electrodes, or by increasing the width and thus the area of the outer-conductor-free areas surrounding the input/output electrodes thereby reducing the input/output electrode-to-outer conductor capacitance. In any case, a reduction in Qo (unloaded Q) occurs, which results in an increase in insertion loss.

As described above, the conventional dielectric filter has the problem that it is expensive to form the inner-conductor-free areas and it is difficult to achieve high performance.

SUMMARY OF THE INVENTION

It is an advantage of the present invention that it can provide a low-cost high-performance dielectric filter in which an electrically open end is formed with high accuracy at a location spaced inward from the physical end face of a dielectric block.

The above advantage is achieved by the present invention as described below. According to a first aspect of the invention, there is provided a dielectric filter comprising: a dielectric block having a pair of end faces; a plurality of inner conductors formed in said dielectric block such that said inner conductors extend between said pair of end faces; and an outer conductor formed on the outer surface of said dielectric block, said dielectric filter having an aperture, slot or hole formed at least at a location near one of said end faces of the dielectric block so that a corresponding said inner conductor is separated by said aperture, slot or hole.

According to a second aspect of the invention, there is provided dielectric filter comprising: a dielectric block having a pair of end faces; a plurality of resonance holes whose inner surface is covered with an inner conductor, said resonance holes being formed in said dielectric block such that said resonance holes extend between said pair of end faces; and an outer conductor formed on the outer surface of said dielectric block, said dielectric filter having an aperture, slot or hole formed at least at a location near one of said end faces of the dielectric block so that a corresponding said inner conductor is separated by said aperture, slot or hole.

According to a third aspect of the invention, based on the above first or second aspect, the dielectric filter further comprises an input/output electrode formed using a part of said outer conductor so that said input/output electrode is capacitively coupled with a corresponding inner conductor and so that an outer-conductor-free area surrounding said input/output electrode is connected to said aperture, slot or hole.

With the above arrangements, apertures, slots or holes are formed in the dielectric block so as to form inner conductor isolation regions serving as electrically open ends of respective resonators so that the electrically open ends are located spaced inward from the end face of the dielectric block thereby ensuring that leakage of electromagnetic field is suppressed by the shielding effect of the outer conductor on the end face.

The apertures, slots or holes providing the electrically open ends may be formed by means of cutting or similar processing using a cutting machine such as a dicer or an ultrasonic cutting machine. Since these slots may be formed simultaneously, it is possible to reduce the number of processing steps required to form the electrically open ends and it is also possible to form the slots with desired widths at desired arbitrary locations with desired accuracy. As a result, it is possible to produce a dielectric filter having small variations in characteristics at low cost.

Furthermore, the gaps formed between the input/output electrodes and the outer conductor cause a reduction in capacitance between the input/output electrodes and the outer conductor, which results in an increase in the external coupling. If the external coupling is allowed to be fixed, it is possible to reduce the areas of the input/output electrodes and the outer-conductor-free areas, which results in an improvement in Qo (unloaded Q). Thus, it is possible to produce a wide-band dielectric filter having a low insertion loss.

DESCRIPTION OF EMBODIMENTS OF THE INVENTION

Figure 1:
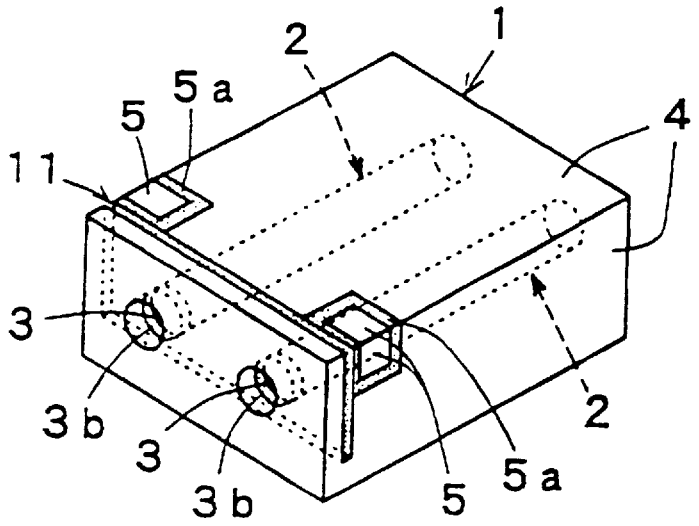
FIG. 1 is a perspective view illustrating the external appearance of a first embodiment of a dielectric filter according to the invention.

The present invention will now be described in greater detail below with reference to embodiments thereof, in conjunction with the accompanying drawings. In the figures, like parts corresponding to those in the conventional dielectric filter are denoted by like reference numerals.

FIG. 1 is a perspective view of a first embodiment of a dielectric filter according to the present invention. In this embodiment, the dielectric filter has a slot 11 extending across it, in parallel to one end face of a dielectric block 1, from its one side to the opposite side. The slot 11 is formed from the surface used as an attachment surface on which input/output electrodes 5, 5 are also formed. Formation of the slot 11 partly removes the inner conductors 3 formed on the inner surface of the resonance holes 2 by cutting the inner conductors 3 all the way through, along the entire circumference thereof, and by partly cutting away the outer-conductor-free areas 5*a*, 5*a* surrounding the respective input/output electrodes 5, 5.

Figure 6:
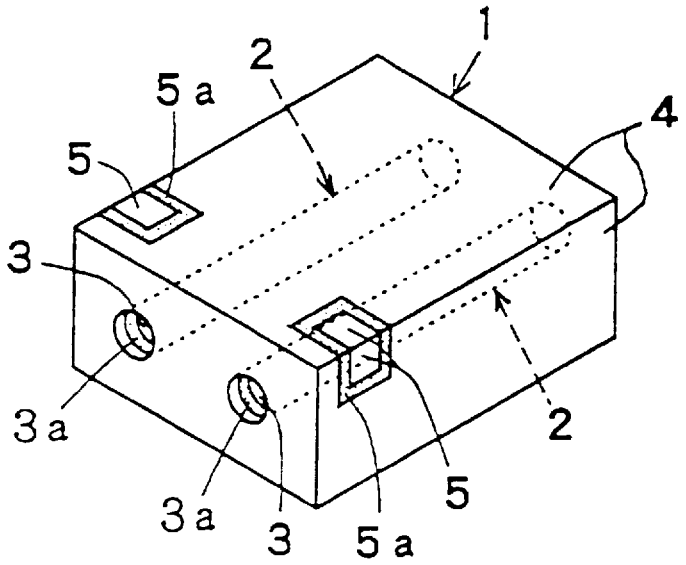
FIG. 6 PRIOR ART
FIG. 6 is a perspective view illustrating the external appearance of a dielectric filter according to a conventional technique.

That is, when the slot 11 is formed by partially cutting away the dielectric block together with the inner conductors 3, 3 with a predetermined proper width, the inner conductor isolation regions 3*b*, 3*b* are formed at locations spaced inward from the end face of the dielectric block 1 thereby forming electrically open ends of the resonators. In this structure, the dielectric block 1 is separated by the slot 11 into two parts: a shielding part and a resonator part. The other parts are similar to those of the conventional dielectric filter described above with reference to FIG. 6, and thus they are not described in further detail here.

The slot 11 may be formed for example by a cutting machine such as a dicer. The width of the slot 11 is determined by the blade thickness of the dicer. The width of the slot 11 can be adjusted to a desired value by properly selecting the thickness of the blade. The depth of the slot 11 is determined taking into account the mechanical strength of the shielding part formed at the location directly adjacent to the end face and also taking into account the electrical characteristics to be obtained.

In the present embodiment, the electrically open ends of the respective resonators are formed by the slot 11 at locations spaced from the end face of the dielectric block 1. Furthermore, leakage of electromagnetic field is greatly suppressed by the shielding effect provided by the outer conductor 4 present near the end face.

The slot 11 also serves as an air layer isolating the respective input/output electrodes 5 from the outer conductor 4. This results in a reduction in capacitance between the input/output electrodes and the outer conductor and thus results in an increase in the external coupling. As a result, it becomes possible to achieve sufficient external coupling even if the areas of the input/output electrodes 5 and the outer-conductor-free regions 5*a* are reduced. This allows Qo and the external coupling to be determined in a more flexible fashion. With the above arrangement, for example, it is possible to expand the passband of a PHS (Personal Handy-Phone System) filter to 240 MHz from 160 MHz which is common in filters according to conventional techniques.

Formation of a single slot 11 may cut a plurality of inner conductors 3 simultaneously and it is also possible for a single slot 11 to be formed simultaneously for a plurality of dielectric blocks 1. This allows a great reduction in the number of processing steps required to form the inner conductor isolation regions 3*b* and also allows improvement in accuracy of the locations and the widths of the inner conductor isolation regions 3*b*.

Figure 2:
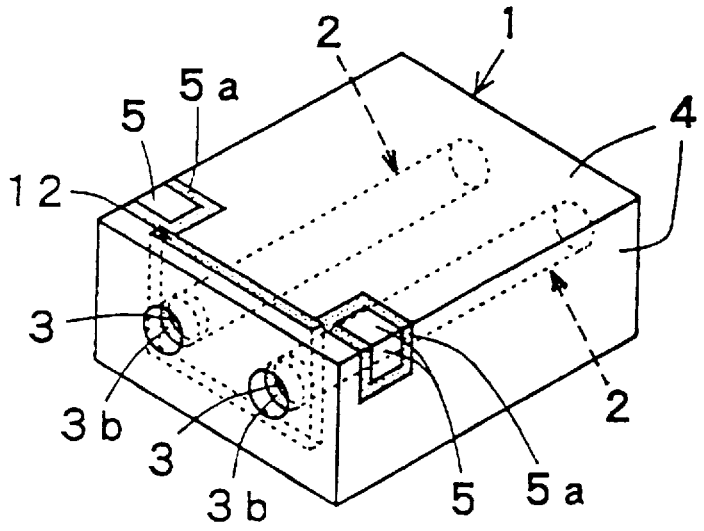
FIG. 2 is a perspective view illustrating the external appearance of a second embodiment of a dielectric filter according to the invention.

FIG. 2 is a perspective view of a second embodiment of a dielectric filter according to the present invention. In this embodiment, the dielectric filter has a slot 12 formed at a location near and in parallel to one end face of a dielectric block 1. The slot 12 has a small width and has a closed bottom. The slot 12 is formed by partially cutting the dielectric block 1 from the attachment surface on which the input/output electrodes 5, 5 are formed such that the outer-conductor-free areas 5*a*, 5*a* surrounding the respective input/output electrodes 5, 5 are partially removed and such that the inner conductors 3, 3 are cut along the entire circumference thereof.

That is, when the slot 12 is formed by partially cutting away the dielectric block together with the inner conductors 3, 3 with a predetermined proper width, the inner conductor isolation regions 3*b*, 3*b* are formed at locations spaced inward from the end face of the dielectric block 1 thereby forming electrically open ends of the resonators. In the present embodiment, as described above, the slot 12 corresponding to the slot 11 of the first embodiment is formed to obtain the inner conductor isolation regions 3*b*, 3*b*.

The slot 12 may be formed using an ultrasonic cutting machine. The shape of the slot 12 is determined by the shape of the tip of the ultrasonic cutting machine.

The above arrangement, as in the first embodiment, allows a great reduction in leakage of electromagnetic field and also a reduction in capacitance between the input/output electrodes and the outer conductor. This allows Qo and the external coupling to be determined in a more flexible fashion.

The slot 12 may be formed by ultrasonic cutting as opposed to the conventional technique in which the inner-conductor-free areas are formed using a router. This allows a great reduction in the number of processing steps required to form the inner conductor isolation regions 3*b*. Furthermore, the structure of the dielectric block 1 according to this second embodiment provides an improved mechanical strength compared with the structure according to the first embodiment.

Figure 2A:
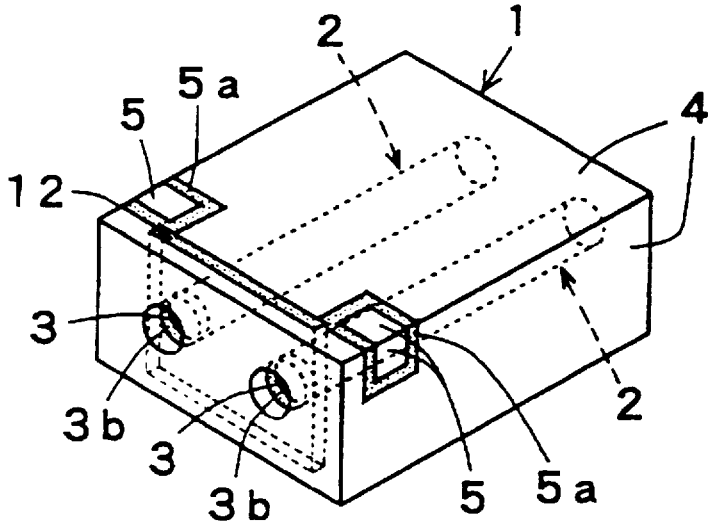
FIG. 2A is a perspective view illustrating the external appearance of a modification of the second embodiment.

In the second embodiment described above, the slot 12 has a closed bottom. However, in a modification of the second embodiment shown in FIG. 2A, slot 12 may also be formed all the way through the dielectric block 1 such that the slot 12 extends from one main surface of the dielectric block 1 to the opposite surface.

Figure 3:
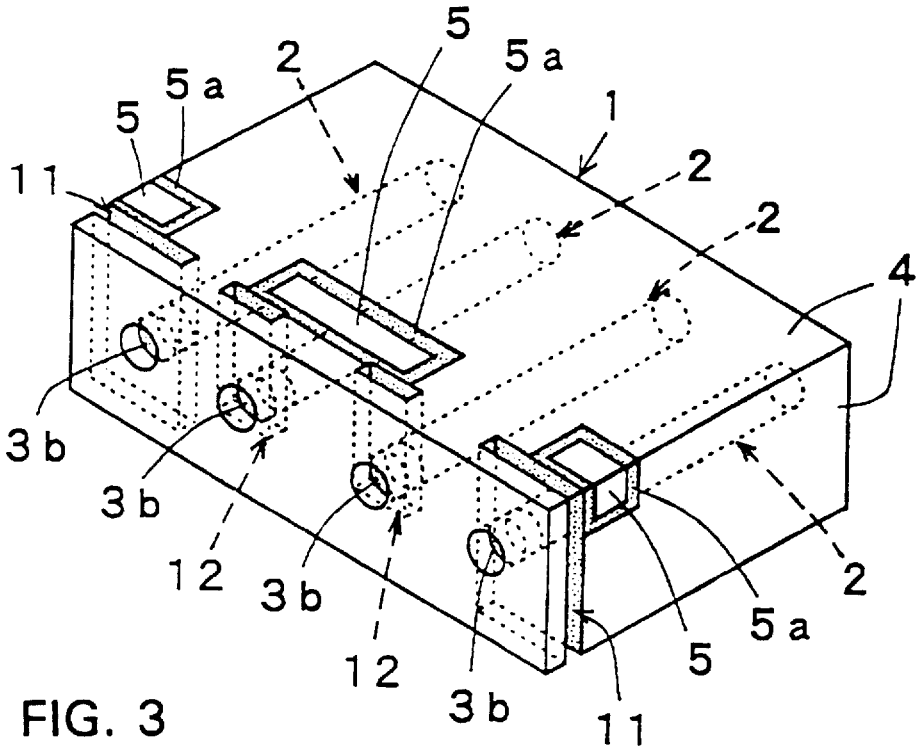
FIG. 3 is a perspective view illustrating the external appearance of a third embodiment of a dielectric filter according to the invention.

FIG. 3 is a perspective view of a third embodiment of a dielectric filter according to the present invention. In this third embodiment, the dielectric filter includes two filters formed in a single dielectric block 1 wherein one filter is for reception and the other one is for transmission so that the dielectric filter can be used as an antenna duplexer. The dielectric filter includes four resonance holes 2 formed in the dielectric block 1 such that each resonance hole 2 extends from one end face to the opposite end face wherein the inner surface of each resonance hole 2 is covered with an inner conductor. Nearly all of the outer surface of the dielectric block 1 is covered with an outer conductor 4. Three input/output electrodes 5 are formed within the outer conductor 4 at proper locations on the outer surface of the dielectric block 1. The input/output electrode 5 located at the center serves as an antenna electrode which is used by both filters.

Slots 11, 11 are formed on either side at locations near one end face of the dielectric block 1 such that the slots 11, 11 extend through the dielectric block 1 from one main surface thereof to the opposite surface. Slots 12, 12 each having a closed bottom are formed in the middle. The slots 11, 11 are formed so that the inner conductors 3, 3 of the respective resonance holes 2, 2 located near either side of the dielectric block 1 are separated into two isolated parts. Similarly, the slots 12, 12 are formed so that the inner conductors 3, 3 of the respective resonance holes 2, 2 located in the middle of the dielectric block 1 are separated into two isolated parts. By the slots 11, 11, 12, 12, inner conductor isolation regions 3*b*, 3*b*, 3*b*, 3*b* are formed at locations spaced inward from the end face of the dielectric block 1. The respective slots 11, 12 also partially remove the outer-conductor-free areas 5*a* surrounding the input/output electrodes 5.

The slots 11, 11 may be formed using a cutting machine such as a dicer. The slots 12, 12 may be formed using a cutting machine such as an ultrasonic cutting machine. In this embodiment, since the respective inner conductors 3 are separated by corresponding slots 11 or 12, it is possible to cut them with desired arbitrary widths at desired arbitrary positions.

Although the slots 11, 11 may be formed using an ultrasonic cutting machine, it is more desirable to form them using a dicer or a similar cutting machine so as to reduce the number of processing steps and thus reduce the production cost.

As described above, even in the structure in which three or more inner conductors are formed in a single dielectric block, it is possible to properly cut all the inner conductors into isolated portions by means of slots properly formed so that similar effects to those obtained in the first and second embodiments are achieved.

Figure 4:
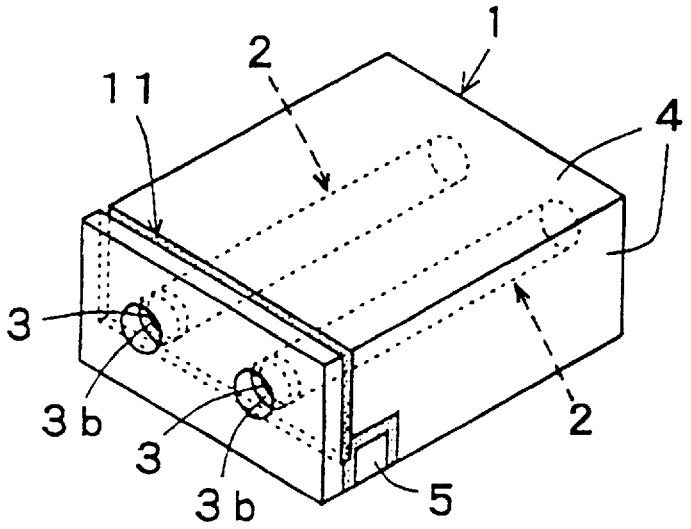
FIG. 4 is a perspective view illustrating the external appearance of another embodiment of a dielectric filter according to the invention.
Figure 5:
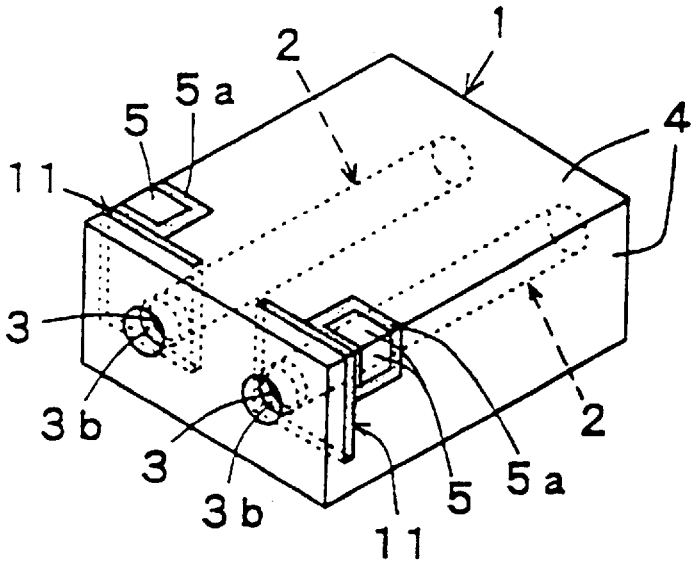
FIG. 5 is a perspective view illustrating the external appearance of still another embodiment of a dielectric filter according to the invention.

The shapes and locations of the slots are not limited to those employed in the above embodiments. For example, the slot 11 may be formed such that it extends inward from the surface opposite to the attachment surface (the lower surface) as shown in FIG. 4. Also, the slots 11 are not necessarily required to extend entirely through the dielectric block from one main surface to the opposite surface, and may be formed for example as shown in FIG. 5. In the case of the structure shown in FIG. 5, the slots 11 may be formed using an ultrasonic cutting machine.

The shapes and locations of the slots may be determined taking into account the required mechanical strength and electrical characteristics and the specifications to be satisfied.

Although in the above embodiments each resonance hole has an uniform diameter, the shape of each resonance hole is not limited to that. For example, the resonance holes may also be formed in a so-called stepped shape having large-diameter and small-diameter portions. When the resonance holes are formed in a stepped shape, it is possible to adjust the coupling between adjacent resonators over a wider range. This allows the dielectric filter to have better performance in an expanded variety of characteristics.

Although in the specific embodiments described above the dielectric filter is assumed to be of a comb line coupling type in which all resonance holes have their electrically open end on the same side, the dielectric filter may also be formed as an interdigital coupling type in which the electrically open ends are arranged alternately on either side. Furthermore, the present invention may also be applied to a dielectric filter in which both ends of resonance holes are electrically open.

Although in the above embodiments the dielectric filter has resonance holes formed in the dielectric block, the invention may also be applied to a dielectric filter having no resonance holes but having inner conductors in the shape of plates formed in a dielectric block. For example, a dielectric block may be formed by placing a plurality of dielectric substrates one on another and bonding them together, or may be formed in a laminated fashion so that a plurality of inner conductor plates acting as resonance electrodes are disposed on at least one surface of the bonded or laminated dielectric substrates.

In the dielectric filter according to the present invention, as described above, slots are formed in a dielectric block so as to form inner conductor isolation regions serving as electrically open ends of respective resonators so that the electrically open ends are located spaced inward from the end face of the dielectric block thereby ensuring that leakage of electromagnetic field is suppressed by the shielding effect of the outer conductor on the end face.

The slots providing the electrically open ends may be formed by cutting or similar processing using a cutting machine such as a dicer or an ultrasonic cutting machine. Since these slots may be formed simultaneously, it is possible to reduce the number of processing steps required to form the electrically open ends and it is also possible to form the slots with desired widths at desired arbitrary locations with desired accuracy. As a result, it is possible to produce a dielectric filter having small variations in characteristics at low cost. In particular, if the slots are formed using a dicer, a great reduction in the number of processing steps can be achieved.

Furthermore, the slots formed between the input/output electrodes and the outer conductor cause a reduction in capacitance between the input/output electrodes and the outer conductor, which results in an increase in the external coupling. Therefore, it is possible to reduce the areas of the input/output electrodes and the outer-conductor-free areas, which results in an improvement in Qo (unloaded Q) . Thus, it is possible to produce a wide-band dielectric filter having a low insertion loss.

Figure 7:
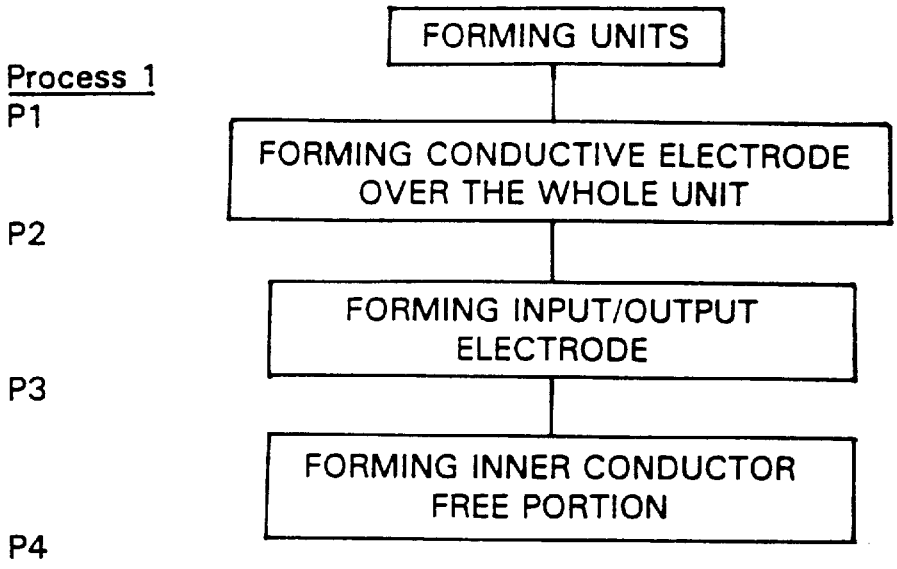
FIG. 7 is a flow diagram illustrating a first example of a process for manufacturing a dielectric filter.
Figure 8:
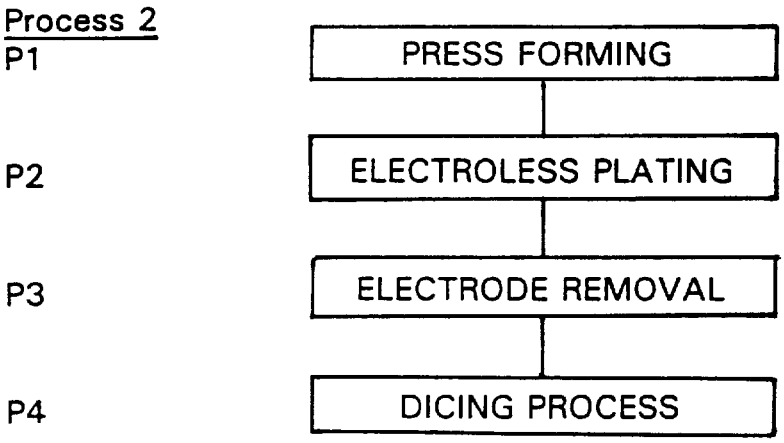
FIG. 8 is a flow diagram illustrating a second example of a process for manufacturing a dielectric filter.
Figure 9:
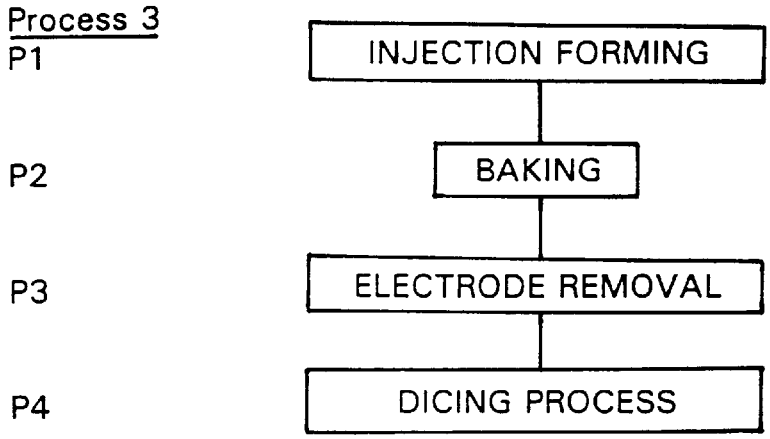
FIG. 9 is a flow diagram illustrating a third example of a process for manufacturing a dielectric filter.

FIGS. 7–9 show three examples of processes for manufacturing a dielectric filter according to embodiments of the invention. In the example shown in FIG. 7, a dielectric block or unit (or a plurality thereof) is first formed at step P1. The dielectric block may be formed by press forming or injection forming, for example, as discussed below in more detail. At step P2, a conductive electrode is formed over the whole unit, providing the outer and inner conductors. At step P3, the input/output electrodes are formed, for example by ultrasonic cutting or sandblasting. At step P4, the inner-conductor-free portion is formed in the dielectric block, for example by dicing.

As illustrated in FIG. 8, according to a more specific example, the dielectric block is formed at step P1 by press forming, that is, by pressing powder material into a metal mold and then firing. Then the conductive electrode can be formed, so as to form the inner and outer electrodes, by dipping the dielectric block into a metal plating liquid, preferably carrying out an electroless plating process to apply a copper electrode material. Then at step P3, the outer electrode can be partially removed to form the input/output electrode or electrodes. As indicated above, the electrode removal step may be carried out by a process such as ultrasonic cutting in an abrasive liquid or, as another example, by a sandblasting process wherein an abrasive material is blown through an electrode pattern, guide or template. Finally, at step P4, the inner-conductor-free portions are formed by a dicing process, wherein the desired portions are cut with a circular blade rotating at a high speed.

Another example of a manufacturing process is shown in FIG. 9. At step P1, the dielectric block may be formed by injection forming, that is, by hardening or congealing a liquid material poured into a metal mold, and thereafter firing. Then at step P2, the electrode, especially a silver electrode material, may be formed by applying a silver paste to the inside and outside of the dielectric block and thereafter firing.

Of course, the electrode-forming process of FIG. 9 can also be used on the press-formed dielectric block of FIG. 8, or alternatively, the above-described electroless plating process of FIG. 8 can be used on an injection-formed dielectric block formed according to FIG. 9. The various process steps described herein can be interchanged and combined in numerous ways that are well-known to those of ordinary skill in the art.

At step P3 in FIG. 9, the input/output electrodes are formed, for example, by one of the methods mentioned above in connection with FIG. 8. At step P4, the inner-conductor-free portions are formed by dicing.

Although examples and embodiments of the invention have been disclosed, the invention is not limited thereby, but rather extends to all variations and modifications that may occur to one having ordinary skill in the relevant art.

What is claimed is:

1. A dielectric filter comprising:

a dielectric block having a pair of end faces;

a plurality of inner conductors formed in said dielectric block such that said inner conductors extend between said pair of end faces and form corresponding resonators; and an outer conductor formed on an outer surface of said dielectric block, at least a single continuous slot being formed through said outer surface of said dielectric block and through a corresponding inner conductor at a respective location in the dielectric block so that said corresponding inner conductor is divided by said slot into two parts to form an electrically open end of said corresponding resonator at said location, an input/output electrode being formed on a part of said outer surface of said dielectric block and insulated from said outer conductor by an outer-conductor-free area surrounding said input/output electrode;

said input/output electrode being capacitively coupled with a corresponding one of said inner conductors;

said outer-conductor-free area surrounding said input/output electrode being partially defined by said slot.

2. A dielectric filter comprising:

a dielectric block having a pair of end faces;

a plurality of resonator holes each having an inner surface covered with an inner conductor to form a corresponding resonator, said resonator holes being formed in said dielectric block such that said resonator holes extend between said pair of end faces; and an outer conductor formed on an outer surface of said dielectric block, at least a single continuous slot being formed through said outer surface of said dielectric block and through a corresponding inner conductor at a respective location in the dielectric block so that said corresponding inner conductor is divided by aid slot into two parts to form an electrically open end of said corresponding resonator at said location, an input/output electrode being formed on a part of said outer surface of said dielectric block and insulated from said outer conductor by an outer-conductor-free area surrounding said input/output electrode;

said input/output electrode being capacitively coupled with a corresponding one of said inner conductors;

wherein said outer-conductor-free area surrounding said input/output electrode is partially defined by said slot.

3. A process for manufacturing a dielectric filter comprising the steps of:

forming a dielectric block having a pair of end faces;

forming a plurality of inner conductor sin said dielectric block such that said inner conductors extend between said pair of end faces and form corresponding resonators;

forming an outer conductor on an outer surface of said dielectric block;

forming at least a single continuous slot through said outer surface of said dielectric block and through a corresponding inner conductor at a respective location in the dielectric block so that said corresponding inner conductor is divided by said slot into two parts to form an electrically open end of said corresponding resonator at said location; and forming an input/output electrode on a part of said outer surface of said dielectric block and insulated from said outer conductor by an outer-conductor-free area surrounding said input/output electrode;

said input/output electrode being capacitively coupled with a corresponding one of said inner conductors; and said outer-conductor-free area surrounding said input/output electrode being partially defined by said slot.

4. A process as in claim 3, wherein said dielectric block is formed by press forming.

5. A process as in claim 3, wherein said dielectric block is formed by injection forming.

6. A process as in claim 3, wherein said inner and outer conductors are formed by electroless plating.

7. A process as in claim 3, wherein said inner and outer conductors are formed by application of electrode material paste followed by baking.

8. A process as in claim 3, wherein said aperture is formed by dicing.

9. A process as in claim 3, wherein said input/output electrode is formed by ultrasonic cutting.

10. A process as in claim 3, wherein said input/output electrode is formed by sandblasting.

11. A process as in claim 3, wherein said inner conductors are formed on a corresponding plurality of resonator holes each having an inner surface covered with a respective inner conductor, said resonator holes being formed in said dielectric block such that said resonator holes extend in a direction defined between said pair of end faces.

12. A dielectric filter according to claim 2, wherein said slot provides an air layer which forms part of said outer-conductor-free area.

13. A dielectric filter according to claim 1, wherein said slot provides an air layer which forms part of said outer-conductor-free area.

14. A process according to claim 3, wherein said slot provides an air layer which forms part of said outer-conductor-free area.

15. A dielectric filter according to claim 1, wherein said dielectric block has a plurality of side faces which extend between said pair of end faces, said slot being formed through only a single one of said side faces.

16. A dielectric filter according to claim 2, wherein said dielectric block has a plurality of side faces which extend between said pair of end faces, said slot being formed through only a single one of said side faces.

17. A process according to claim 3, wherein said dielectric block has a plurality of side faces which extend between said pair of end faces, said slot being formed through only a single one of said side faces.

18. A dielectric filter according to claim 1, wherein said dielectric block has a plurality of side face which extend between said pair of end faces, said input/output electrode being formed on one of said side faces, said slot being formed through only said one of said side faces on which said input/output electrode is also formed.

19. A dielectric filter according to claim 2, wherein said dielectric block has a plurality of side face which extend between said pair of end faces, said input/output electrode being formed on one of said side faces, said slot being formed through only said one of said side faces on which said input/output electrode is also formed.

20. A process according to claim 3, wherein said dielectric block has a plurality of side faces which extend between said pair of end faces, said input/output electrode being formed on one of said side faces, said slot being formed through only said one of said side faces on which said input/output electrode is also formed.

21. A dielectric filter comprising:

a dielectric block having a pair of end faces;

at least one inner conductor formed in said dielectric block such that said inner conductor extends between said pair of end faces; and an outer conductor formed on an outer surface of said dielectric block, said dielectric filter having at least one slot formed through said outer surface of said dielectric block and through said inner conductor at a respective location near a corresponding one of said end faces of the dielectric block, said inner conductor being divided by said slot into a first part which forms a corresponding resonator which resonates at a resonant frequency, said slot forming an electrically open end of said resonator at said location near said corresponding end face of said dielectric block, and said slot forming a second part of said inner conductor which is substantially non-resonant at said resonant frequency.

22. A process for manufacturing a dielectric filter comprising the steps of:

forming a dielectric block having a pair of end faces;

forming at least one inner conductor in said dielectric block such that said inner conductor extends between said pair of end faces and forms a corresponding resonator;

forming an outer conductor on an outer surface of said dielectric block; and forming at least one slot by cutting through said outer surface of said dielectric block together with said inner conductor at a respective location near a corresponding one of said end faces of the dielectric block, said inner conductor being divided by said slot into a first part which forms a corresponding resonator which resonates at a resonant frequency, said slot forming an electrically open end of said resonator at said location near said corresponding end face of said dielectric block, and said slot forming a second part of said inner conductor which is substantially non-resonant at said resonant frequency.

23. A process for manufacturing a dielectric filter having a desired resonant frequency, comprising the steps of:

forming a dielectric block having a pair of end faces;

forming at least one resonator hole in said dielectric block, said resonator hole having an inner conductor which extends between said pair of end faces and forms a corresponding resonator;

forming an outer conductor on an outer surface of said dielectric block; and forming at least one slot by cutting through said outer surface of said dielectric block together with said inner conductor at a respective location near a corresponding one of said end faces of the dielectric block, said slot being located so as to shorten said resonator formed by said inner conductor so that said resonator resonates at said desired resonant frequency, said slot forming an electrically open end of said resonator at said location near said corresponding end face of said dielectric block wherein said slot also forms another part of said inner conductor which is substantially non-resonant at said resonant frequency.

24. A dielectric filter according to claim 1, wherein said inner conductors are formed on a corresponding plurality of resonator holes each having an inner surface covered with a respective inner conductor, said resonator holes being formed in said dielectric block such that said resonator holes extend in a direction defined between said pair of end faces.

25. A dielectric filter according to claim 21, wherein said inner conductors are formed on a corresponding plurality of resonator holes each having an inner surface covered with a respective inner conductor, said resonator holes being formed in said dielectric block such that said resonator holes extend in a direction defined between said pair of end faces.

26. A process according to claim 22, wherein said inner conductors are formed on a corresponding plurality of resonator holes each having an inner surface covered with a respective inner conductor, said resonator holes being formed in said dielectric block such that said resonator holes extend in a direction defined between said pair of end faces.

27. A dielectric filter according to claim 1, wherein said slot is further formed through another inner conductor adjacent to said corresponding inner conductor.

28. A dielectric filter according to claim 2, wherein said slot is further formed through another inner conductor adjacent to said corresponding inner conductor.

29. A dielectric filter according to claim 3, wherein said slot is further formed through another inner conductor adjacent to said corresponding inner conductor.

30. A dielectric filter according to claim 21, wherein said at least one inner conductor comprises a pair of adjacent inner conductors, said slot being formed continuously through both of said pair of adjacent inner conductors.

31. A dielectric filter according to claim 22, wherein said at least one inner conductor comprises a pair of adjacent inner conductors, said slot being formed continuously through both of said pair of adjacent inner conductors.

32. A dielectric filter according to claim 23, wherein said at least one inner conductor comprises a pair of adjacent inner conductors, said slot being formed continuously through both of said pair of adjacent inner conductors.

33. A dielectric filter according to claim 15, wherein said slot is further formed through another inner conductor adjacent to said corresponding inner conductor.

34. A dielectric filter according to claim 16, wherein said slot is further formed through another inner conductor adjacent to said corresponding inner conductor.

35. A dielectric filter according to claim 17, wherein said slot is further formed through another inner conductor adjacent to said corresponding inner conductor.

36. A dielectric filter according to claim 1, wherein said dielectric block has a plurality of side faces which extend between said pair of end faces, said slot being formed through a pair of said side faces which are opposite to each other.

37. A dielectric filter according to claim 36, wherein said slot is further formed through another inner conductor adjacent to said corresponding inner conductor.

38. A dielectric filter according to claim 2, wherein said dielectric block has a plurality of side faces which extend between said pair of end faces, said slot being formed through a pair of said side faces which are opposite to each other.

39. A dielectric filter according to claim 38, wherein said slot is further formed through another inner conductor adjacent to said corresponding inner conductor.

40. A dielectric filter according to claim 3, wherein said dielectric block has a plurality of side faces which extend between said pair of end faces, said slot being formed through a pair of said side faces which are opposite to each other.

41. A dielectric filter according to claim 40, wherein said slot is further formed through another inner conductor adjacent to said corresponding inner conductor.

42. A dielectric filter according to claim 21, wherein said dielectric block has a plurality of side faces which extend between said pair of end faces, said slot being formed through a pair of said side faces which are opposite to each other.

43. A dielectric filter according to claim 22, wherein said dielectric block has a plurality of side faces which extend between said pair of end faces, said slot being formed through a pair of said side faces which are opposite to each other.

44. A dielectric filter according to claim 43, wherein said at least one inner conductor comprises a pair of adjacent inner conductors, said slot being formed continuously through both of said pair of adjacent inner conductors.

45. A dielectric filter according to claim 23, wherein said dielectric block has a plurality of side faces which extend between said pair of end faces, said slot being formed through a pair of said side faces which are opposite to each other.

46. A dielectric filter according to claim 45, wherein said at least one inner conductor comprises a pair of adjacent inner conductors, said slot being formed continuously through both of said pair of adjacent inner conductors.

47. A dielectric filter according to claim 21, wherein said dielectric block has a plurality of side faces which extend between said pair of end faces, said slot being formed through only a single one of said side faces.

48. A dielectric filter according to claim 47, wherein said at least one inner conductor comprises a pair of adjacent inner conductors, said slot being formed continuously through both of said pair of adjacent inner conductors.

49. A dielectric filter according to claim 22, wherein said dielectric block has a plurality of side faces which extend between said pair of end faces, said slot being formed through only a single one of said side faces.

50. A dielectric filter according to claim 49, wherein said at least one inner conductor comprises a pair of adjacent inner conductors, said slot being formed continuously through both of said pair of adjacent inner conductors.

51. A dielectric filter according to claim 23, wherein said dielectric block has a plurality of side faces which extend between said pair of end faces, said slot being formed through only a single one of said side faces.

52. A dielectric filter according to claim 51, wherein said at least one inner conductor comprises a pair of adjacent inner conductors, said slot being formed continuously through both of said pair of adjacent inner conductors.

53. A dielectric filter according to claim 21, wherein said dielectric block has a plurality of side faces which extend between said pair of end faces, further comprising an input/output electrode formed on one of said side faces, said slot being formed through only said one of said side faces on which said input/output electrode is also formed.

54. A dielectric filter according to claim 22, wherein said dielectric block has a plurality of side faces which extend between said pair of end faces, further comprising an input/output electrode formed on one of said side faces, said slot being formed through only said one of said side faces on which said input/output electrode is also formed.

55. A dielectric filter according to claim 23, wherein said dielectric block has a plurality of side faces which extend between said pair of end faces, further comprising an input/output electrode formed on one of said side faces, said slot being formed through only said one of said side faces on which said input/output electrode is also formed.

56. A dielectric filter according to claim 42, wherein said at least one inner conductor comprises a pair of adjacent inner conductors, said slot being formed continuously through both of said pair of adjacent inner conductors.

* * * * *